US008630558B2

(12) United States Patent
Nishimura et al.

(10) Patent No.: US 8,630,558 B2
(45) Date of Patent: Jan. 14, 2014

(54) ELECTROPHOTOGRAPHIC APPARATUS HAVING AN ELECTROPHOTGRAPHIC PHOTOSENSITIVE MEMBER WITH AN AMORPHOUS SILICON CARBIDE SURFACE LAYER

(75) Inventors: Yuu Nishimura, Suntou-gun (JP); Kazuyoshi Akiyama, Mishima (JP); Tomohito Ozawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 411 days.

(21) Appl. No.: 12/952,311

(22) Filed: Nov. 23, 2010

(65) Prior Publication Data

US 2011/0123215 A1 May 26, 2011

(30) Foreign Application Priority Data

Nov. 25, 2009 (JP) ..... 2009-267746
Nov. 18, 2010 (JP) ..... 2010-257817

(51) Int. Cl.
*G03G 21/20* (2006.01)
*G03G 15/00* (2006.01)
*G03G 15/02* (2006.01)

(52) U.S. Cl.
USPC ..... 399/92; 399/159; 399/116; 430/57.4

(58) Field of Classification Search
USPC ..... 399/159, 92, 116; 430/66, 57.4
See application file for complete search history.

(56) References Cited

U.S. PATENT DOCUMENTS 4,555,464 A 11/1985 Kido et al.
4,559,289 A 12/1985 Sunagawa et al.
4,569,855 A 2/1986 Matsuda et al.
4,659,639 A 4/1987 Mizuno et al.
4,683,144 A 7/1987 Nishimura et al.
4,683,145 A 7/1987 Nishimura et al.
4,683,146 A 7/1987 Hirai et al.
4,683,147 A 7/1987 Eguchi et al.
4,777,103 A 10/1988 No et al.
4,795,691 A 1/1989 Takei et al.
5,112,709 A 5/1992 Yamazaki et al.
5,164,281 A 11/1992 Hayakawa et al.
5,392,098 A 2/1995 Ehara et al.
5,455,138 A 10/1995 Okamura et al.
5,480,750 A 1/1996 Kawada et al.
5,582,944 A 12/1996 Yamamura et al.

(Continued)

FOREIGN PATENT DOCUMENTS

EP 0 220 993 A 5/1987
EP 1 887 427 A 2/2008

(Continued)

*Primary Examiner* — Billy J Lactaoen

(74) *Attorney, Agent, or Firm* — Fitzpatrick, Cella, Harper & Scinto

(57) ABSTRACT

An electrophotographic apparatus has an electrophotographic photosensitive member having a surface layer of an amorphous silicon carbide. The ratio of the atom density (C) of carbon atoms to the sum of the atom density (Si) of silicon atoms and the atom density (C) of carbon atoms, C/(Si+C), in the surface layer is set larger from one end portion toward the other end portion of the electrophotographic photosensitive member in the direction of rotational axis thereof, and is from 0.61 or more to 0.75 or less in the entire region of the electrophotographic photosensitive member in the direction of rotational axis thereof. The electrophotographic apparatus has an air current generator which draws out air from the side of the one end portion toward the side of the other end portion.

2 Claims, 5 Drawing Sheets

(56) References Cited

U.S. PATENT DOCUMENTS

| | | | | |
|---|---|---|---|---|
| 5,817,181 | A | 10/1998 | Okamura et al. | |
| 5,849,446 | A | 12/1998 | Hashizume et al. | |
| 5,976,745 | A | 11/1999 | Aoki et al. | |
| 6,110,629 | A | 8/2000 | Ehara et al. | |
| 6,122,467 | A | 9/2000 | Ehara et al. | |
| 6,183,930 | B1 | 2/2001 | Ueda et al. | |
| 6,233,417 | B1 | 5/2001 | Nakayama et al. | |
| 6,238,832 | B1 | 5/2001 | Hashizume et al. | |
| 6,322,943 | B1 | 11/2001 | Aoki et al. | |
| 6,605,405 | B2 | 8/2003 | Owaki et al. | |
| 7,033,717 | B2 | 4/2006 | Kojima et al. | |
| 7,157,197 | B2 | 1/2007 | Aoki et al. | |
| 7,255,969 | B2 | 8/2007 | Kojima et al. | |
| 7,498,110 | B2 | 3/2009 | Taniguchi et al. | |
| 2007/0154239 | A1* | 7/2007 | Fukunaga et al. | 399/159 |
| 2010/0021835 | A1 | 1/2010 | Akiyama et al. | |
| 2010/0021836 | A1* | 1/2010 | Ozawa et al. | 430/66 |
| 2010/0021837 | A1 | 1/2010 | Ozawa et al. | |
| 2010/0112470 | A1 | 5/2010 | Ohira et al. | |

FOREIGN PATENT DOCUMENTS

| | | | |
|---|---|---|---|
| EP | 2 148 245 | A1 | 1/2010 |
| EP | 1 158 368 | A2 | 11/2011 |
| JP | 58-080656 | A | 5/1983 |
| JP | 04-093864 | A | 3/1992 |
| JP | 05-018471 | A | 1/1993 |
| JP | 06-102686 | A | 4/1994 |
| JP | 06-250425 | A | 9/1994 |
| JP | 07-043921 | A | 2/1995 |
| JP | 07-175244 | A | 7/1995 |
| JP | 08-022229 | A | 1/1996 |
| JP | 09-297420 | A | 11/1997 |
| JP | 09292805 | A | * 11/1997 |
| JP | 10-104911 | A | 4/1998 |
| JP | 11-161120 | A | 6/1999 |
| JP | 2000-003055 | A | 1/2000 |
| JP | 03-124841 | A | 1/2001 |
| JP | 2001-330978 | A | 11/2001 |
| JP | 2002-123020 | A | 4/2002 |
| JP | 2002-148907 | A | 5/2002 |
| JP | 2002-229303 | A | 8/2002 |
| JP | 2002-296987 | A | 10/2002 |
| JP | 2002296987 | A | * 10/2002 |
| JP | 2003-107766 | A | 4/2003 |
| JP | 2003-107767 | A | 4/2003 |
| JP | 2003-337437 | A | 11/2003 |
| JP | 2004-077650 | A | 3/2004 |
| JP | 2004-126347 | A | 4/2004 |
| JP | 2004-133397 | A | 4/2004 |

* cited by examiner

ELECTROPHOTOGRAPHIC APPARATUS HAVING AN ELECTROPHOTGRAPHIC PHOTOSENSITIVE MEMBER WITH AN AMORPHOUS SILICON CARBIDE SURFACE LAYER

BACKGROUND OF THE INVENTION

1. Field of the Invention

This invention relates to an electrophotographic apparatus.

2. Description of the Related Art

Image forming apparatus of electrophotographic systems, i.e., electrophotographic apparatus, have electrophotographic photosensitive members on which electrostatic latent images and toner images are to be formed. Such electrophotographic photosensitive members are required to have quality and stability for electrophotographic performance (electric-potential characteristics such as charging performance, photosensitivity and residual potential and image characteristics such as resolution and gradation) and durability (wear resistance, print resistance, environmental resistance and chemical resistance. Those having a conductive substrate and provided thereon in layers a photoconductive layer as a photosensitive layer and a surface layer are proposed as the electrophotographic photosensitive member. The electrophotographic photosensitive member is hereinafter also simply termed "photosensitive member".

For the surface layer, various materials and layer constitution have been proposed until now. As an example thereof, they may include amorphous silicon materials which contain silicon atoms (hereinafter also termed "Si" or "Si atoms"). In particular, amorphous silicon carbide (hereinafter also termed "a-SiC") incorporated with carbon atoms (hereinafter also termed "C" or "C atoms") in addition to Si atoms has been put into practical use. As the a-SiC, an a-SiC incorporated with an element other than the C is also proposed. For example, it may include amorphous hydrogenated silicon carbide (a-SiC:H) incorporated with C atoms and hydrogen atoms (hereinafter also termed "H" or "H atoms") and amorphous fluorinated silicon carbide (a-SiC:F) incorporated with C atoms and fluorine atoms. These are hereinafter generally referred to as "amorphous silicon carbide" and also termed the "a-SiC". The surface layer formed of such a C-containing amorphous silicon material has superior electrical properties and optical properties, contributes to superior image characteristics and also has superior durability standing on a high hardness.

As the electrophotographic photosensitive members, those having such a surface layer and a photoconductive layer of amorphous silicon type in combination (the amorphous silicon is hereinafter also termed "a-Si") have already been put into practical use.

In the electrophotographic apparatus, in order to uniformly charge the photosensitive member electrostatically by means of a charging assembly, corona discharging is often used as a charging system. However, discharge products as exemplified by oxygen ions, ozone, nitrogen oxides and various radicals are produced by this corona discharging. Then, these discharge products stay inside the electrophotographic apparatus at a high concentration, whereupon such discharge products may make the surface of the photosensitive member change in properties to change the quantity of wear of the surface layer.

As the cause of a change in the quantity of wear of the photosensitive member surface, it is considered that the discharge products make the surface layer change in properties into a film having a low hardness. As another factor, it is considered that the surface layer changes in properties to make a cleaning blade change in state of its rubbing against the photosensitive member surface.

Such changes in properties of the surface layer that are caused by the discharge products may also progress non-uniformly in the direction of rotational axis. This is, as one of the causes, due to the fact that the discharge products differ in their concentration at places inside the electrophotographic apparatus, in particular, at places around the photosensitive member. The difference in concentration of discharge products that is caused at places around the photosensitive member is greatly concerned with influences of air current which are due to the draw-in and draw-out of air that is caused by a fan provided inside the electrophotographic apparatus. Then, any non-uniform progress of such changes in properties of the surface layer finally causes the phenomenon that the surface layer differs in its quantity of wear in the direction of rotational axis.

Such discharge products (such as ozone and nitrogen oxides) are produced also in charging systems other than the corona discharging, e.g., in a roller charging system, though there is a difference in quantity. Hence, the surface layer comes to undergo oxidation or changes in properties like the corona discharging system to cause poor image formation and changes in quantity of wear.

Japanese Patent Application Laid-Open No. H11-161120 discloses a method in which, in order to remove discharge products from the photosensitive member surface, the air in the vicinity of the charging assembly is removed by using a suction means such as a fan. Japanese Patent Application Laid-Open No. 2002-296987 also discloses a method in which, about specific substances among the discharge products, a concentration control unit is provided so as to make them into a stated concentration or below. Japanese Patent Application Laid-Open No. 2002-148907 still also discloses a method in which the discharge products are sucked in the direction of the charging assembly.

However, in any of the above background art methods, the discharge products are removed by using an air current generation means such as a fan, and hence the removal of discharge products may come non-uniform depending on the positional relationship with the air current generation means to give the difference in quantity of wear of the surface layer.

Where the discharge products have gathered on one side of the direction of rotational axis, a phenomenon called one-side wear may occur in which the quantity of wear becomes large on one end side of the direction of rotational axis. Such a case may lead up to occurrence of faulty cleaning.

SUMMARY OF THE INVENTION

An object of the present invention is to make uniform the quantity of wear in the surface layer of a photosensitive member against any change in properties that is due to the discharge products.

The present invention is an electrophotographic apparatus which comprises an electrophotographic photosensitive member having a surface layer constituted of an amorphous silicon carbide, wherein; the ratio of the atom density (C) of carbon atoms to the sum of the atom density (Si) of silicon atoms and the atom density (C) of carbon atoms, C/(Si+C), in the surface layer is set larger from one end portion toward the other end portion of the electrophotographic photosensitive member in the direction of rotational axis thereof, and is from 0.61 or more to 0.75 or less in the whole region of the electrophotographic photosensitive member in the direction of rotational axis thereof; and the electrophotographic apparatus has an air current generation means which draws out air from the side of the above one end portion toward the side of the above other end portion.

The present invention enables reduction of any difference or non-uniformity of quantity of wear of the surface layer in the direction of rotational axis of the electrophotographic photosensitive member. As the result, any density non-uniformity of images formed and any faulty cleaning can be kept from occurring, and hence good image quality is maintained.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments of the present invention are described below in detail.

Electrophotographic Apparatus

The electrophotographic apparatus of the present invention is described first.

Figure 1:
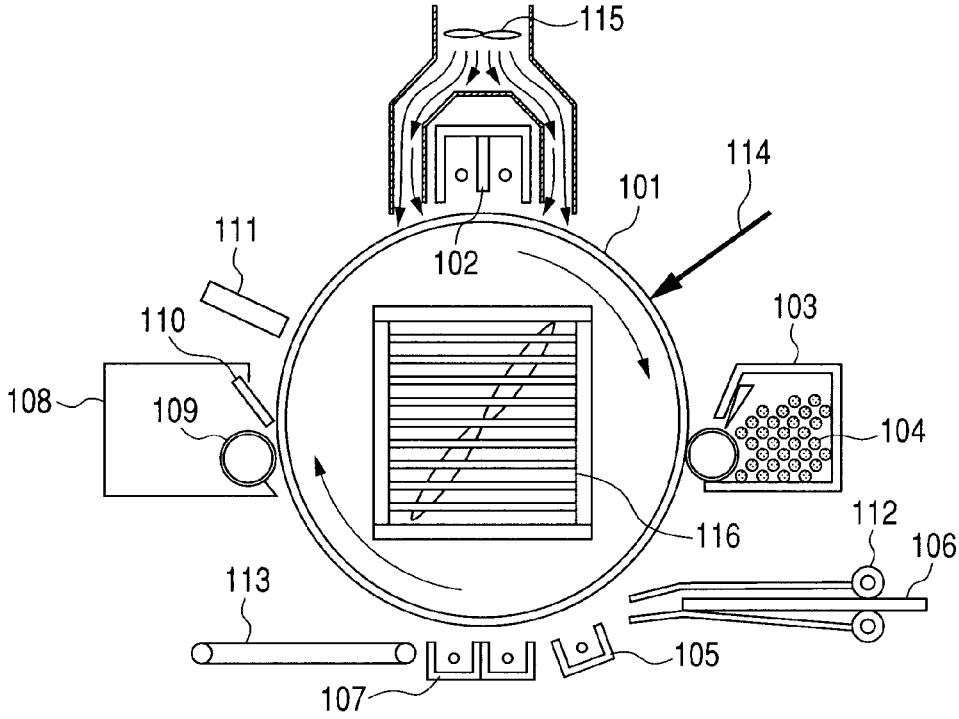
FIG. 1 is a schematic view showing an embodiment of the electrophotographic apparatus of the present invention.

In FIG. 1, reference numeral 101 denotes an electrophotographic photosensitive member; and 102, a primary charging assembly which performs charging before an electrostatic latent image is formed on the electrophotographic photosensitive member 101. Reference numeral 103 denotes a developing assembly for feeding a toner 104 that is a developing material, to the electrophotographic photosensitive member 101, on which the electrostatic latent image has been formed. Reference numeral 105 denotes a transfer charging assembly for transferring the toner on the photosensitive member surface to a transfer material 106. Reference numeral 107 denotes a separation charging assembly for lowering electrostatic attraction force of the transfer material 106 to separate the transfer material 106 from the photosensitive member.

Reference numeral 108 denotes a cleaning unit which performs the cleaning of the photosensitive member surface. In this example, in order to effectively perform uniform cleaning of the photosensitive member surface, the photosensitive member surface is cleaned by using a magnet roller 109 and a cleaning blade 110, either of which, however, may be used alone.

Reference numeral 111 denotes a charge elimination lamp for eliminating electric charges on the photosensitive member surface so as to be ready for the next copying operation; 112, a feed roller for the transfer material 106, such as paper; and 113, a transport roller which transports the transfer material 106 on which images have been formed. Reference numeral 114 denotes imagewise exposure light, for which any light emitted from a halogen light source or a light source chiefly having single wavelength is used. Reference numeral 115 denotes an air fan as an air current generation means for sending air to the surface of the photosensitive member 101. The air fan as an air current generation means sends the air toward an end portion of the electrophotographic photosensitive member in the direction of its rotational axis; the end portion having a higher C atom density. Reference numeral 116 also denotes an air draw-out fan as another air current generation means for drawing out the air in the direction of rotational axis of the photosensitive member 101.

Figure 2:
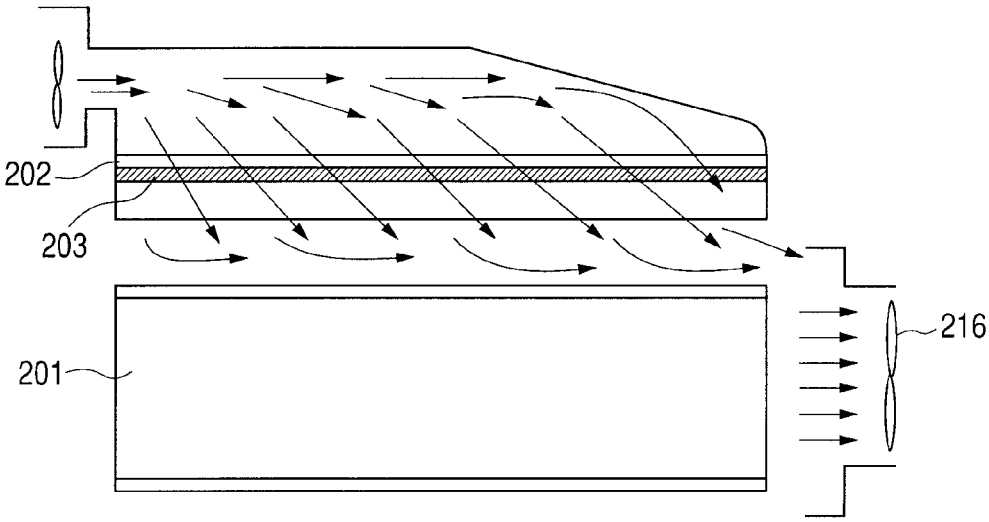
FIG. 2 is a schematic view showing an embodiment of the electrophotographic apparatus of the present invention.

The positional relationship between the air current generation means 115 and 116, the primary charging assembly 102 and the photosensitive member 101 is shown in FIG. 2 as a diagrammatic view of a section taken in the direction of rotational axis.

The air sent from an air fan 215 as the air current generation means for sending air to the surface of an electrophotographic photosensitive member 201 passes through the vicinity of a primary charging assembly 202 or through the inside of the primary charging assembly 202 and a charging wire 203, and reaches the surface of the electrophotographic photosensitive member 201. Then, the air having been sent to the photosensitive member 201 is drawn out by means of an air draw-out fan 216 as an air current generation means for drawing out the air in the direction of rotational axis of the electrophotographic photosensitive member 201. Thus, the discharge products produced at the primary charging assembly pass through the end portion side having a higher C atom density and are removed from the interior of the electrophotographic apparatus.

Figure 3:
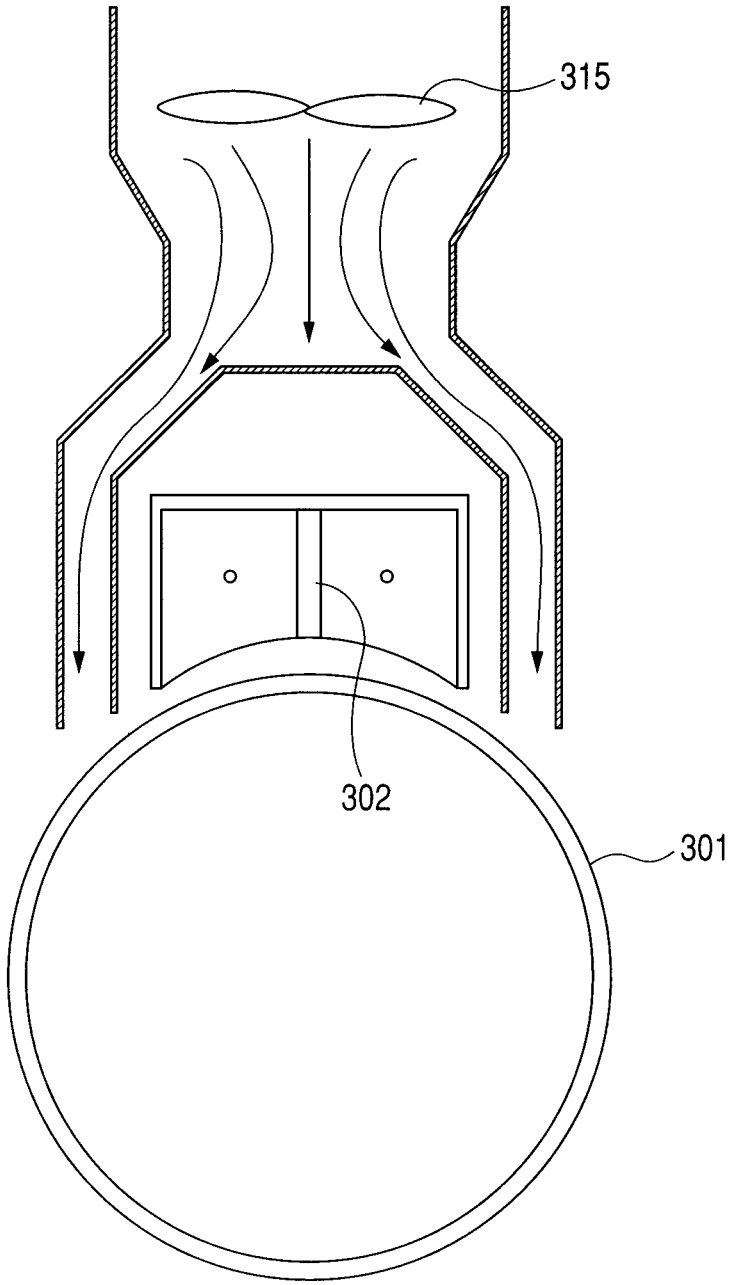
FIG. 3 is a schematic view showing an embodiment of the electrophotographic apparatus of the present invention.

A case in which the air is sent by an air fan 315 from the vicinity of a primary charging assembly 302 to the surface of an electrophotographic photosensitive member 301 is shown in FIG. 3 as a diagrammatic view. By means of the air fan 315 shown in FIG. 3, the air is actively sent to the surface of the electrophotographic photosensitive member 301, whereby the discharge products around the electrophotographic photosensitive member 301 can effectively be removed.

Figure 4:
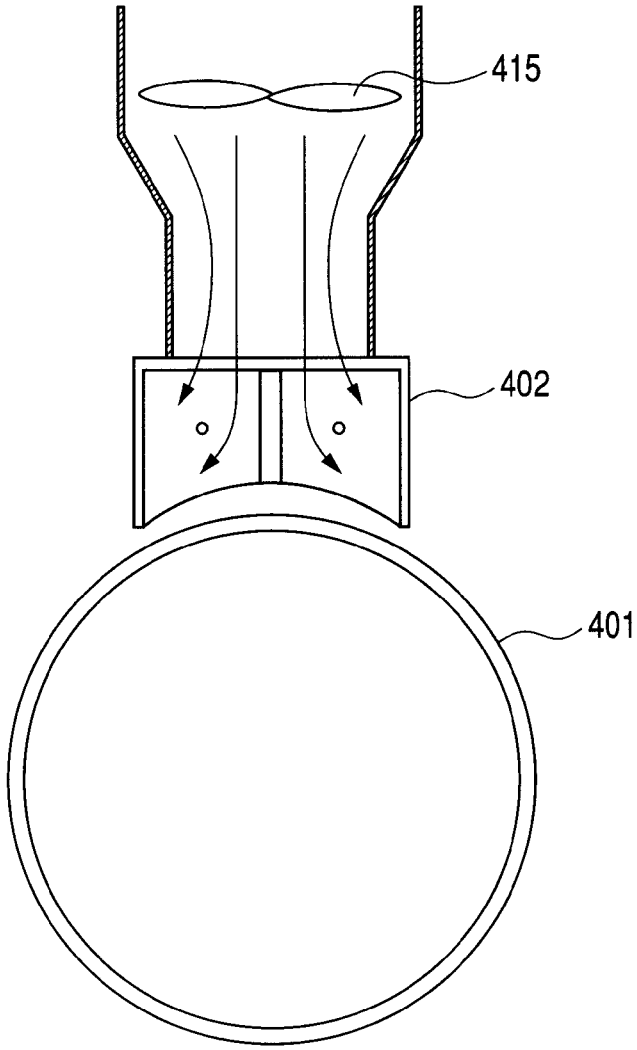
FIG. 4 is a schematic view showing an embodiment of the electrophotographic apparatus of the present invention.

A FIG. 4 diagrammatic view also shows a case in which, by means of an air fan 415, the air is made to pass through the inside of a primary charging assembly 402 and is sent to the surface of an electrophotographic photosensitive member 401. The air current generation means shown in FIG. 4, which makes the air pass through the inside of the primary charging assembly 402, can send the air in a larger quantity than the air current generation means shown in FIG. 3, to regions where the discharge products are much present, and hence the discharge products around the electrophotographic photosensitive member 401 can more effectively be removed.

Then, using the apparatus set up as above, images are formed. The images are formed, e.g., in the following way, as described with reference to FIG. 1.

First, the electrophotographic photosensitive member 101 is rotated in the direction of an arrow at a stated speed, and the surface of the photosensitive member 101 is uniformly electrostatically charged by means of the primary charging assembly 102. Next, the surface of the photosensitive member 101 thus charged is subjected to imagewise exposure to form an electrostatic latent image on the surface of the photosensitive member 101. Thereafter, when the surface of the photosensitive member 101 at its part where the electrostatic latent image has been formed passes the part provided with the developing assembly 103, the toner 104 is fed to the surface of the photosensitive member 101 by means of the developing assembly 103, and the electrostatic latent image is developed, so that a toner image is formed. This toner image is, as the photosensitive member 101 is rotated, sent to the part provided with the transfer charging assembly 105, where it is transferred to the transfer material 106, which is forwarded by means of the feed roller 112.

Since the transfer material 106 to which the toner image has been transferred is kept attracted to the photosensitive member 101 by electrostatic attraction force, it is separated from the photosensitive member 101 by means of a separation charging assembly 107. Then, the transfer material 106 is transported by the transport roller 113 which transports the same. As to the photosensitive member 101 from which the transfer material 106 has been separated, any toner 104 remaining on its surface is removed by the cleaning unit, in order to make preparation for the next image formation. Thereafter, electric charges on its surface are eliminated by means of the charge elimination lamp 111 so that the surface potential may come to zero or substantially zero. Thus, a first-time image formation step is completed.

Next, a substrate used in an electrophotographic photosensitive member and the electrophotographic photosensitive member are described which are used in the present invention.

Substrate

As a material for the substrate, copper, aluminum, nickel, cobalt, iron, chromium, molybdenum, titanium or an alloy of any of these may be used, for example. In particular, taking account of workability and production cost, aluminum is advantageous. In this case, it is preferable to use any of Al—Mg type alloys and Al—Mn type alloys. The substrate may, e.g., be worked by mirror cutting on its surface before it is treated in a substrate cleaning unit.

Electrophotographic Photosensitive Member

Figure 5:
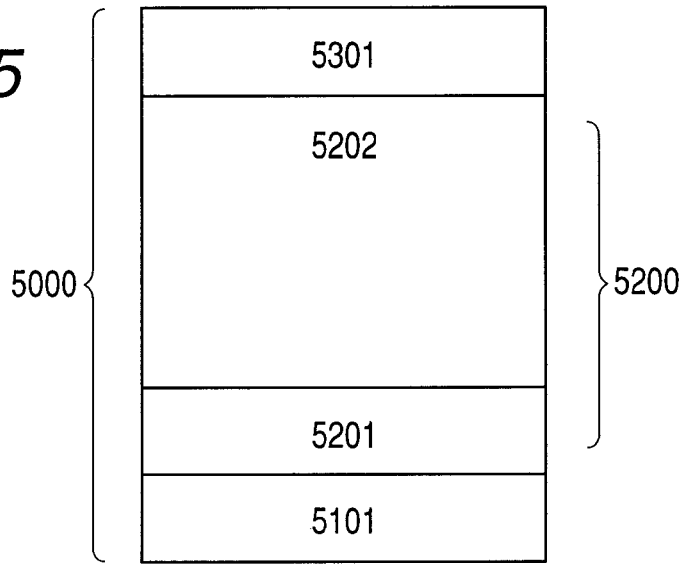
FIG. 5 is a sectional view of layer constitution used in an electrophotographic photosensitive member.

FIG. 5 is a diagrammatic view of an electrophotographic photosensitive member 5000 having a cylindrical substrate 5101 having been cleaned, and provided thereon in layers a charge injection blocking layer 5201, a photoconductive layer 5202 and a surface layer 5301 in this order.

The respective layers constituting the electrophotographic photosensitive member are described with reference to FIG. 5.

Surface Layer

For the surface layer 5301, in the present invention an amorphous silicon carbide (a-SiC) material is used, which is an amorphous silicon material incorporated with C atoms. Stated more specifically, a material is used which is composed of amorphous silicon containing C atoms (C) and H atoms (H) (hereinafter also termed "a-SiC:H"). Instead, a material may also be used which is composed of amorphous silicon containing C atoms (C) and H atoms (H) and/or halogen atoms (X) (hereinafter also termed "a-SiC:H,X"). This is because, as stated previously, the surface layer can have superior electrical properties and optical properties, contribute to superior image characteristics and also have superior durability standing on a high hardness.

In the present invention, the ratio of the atom density (C) of C atoms to the sum of the atom density (Si) of Si atoms and the atom density (C) of C atoms contained in the surface layer, C/(Si+C), stands gradually larger from one end portion toward the other end portion of the electrophotographic photosensitive member in the direction of its rotational axis. Also, the end portion having a higher C atom density is positioned on the air draw-out side of the air current generation means.

The ratio of the atom density (C) of C atoms to the sum of the atom density (Si) of Si atoms and the atom density (C) of C atoms in the a-SiC surface layer, C/(Si+C), is also set within the range of from 0.61 or more to 0.75 or less in the whole region of the electrophotographic photosensitive member in the direction of its rotational axis.

Further, the sum of the atom density of Si atoms and the atom density of C atoms in the a-SiC surface layer (hereinafter also termed "Si+C atom density") may preferably be so set as to be $6.60\times10^{22}$ atom/cm$^3$ or more.

Incidentally, the atom density of Si atoms is hereinafter also termed "Si atom density". Also, the atom density of C atoms is hereinafter also termed "C atom density".

The reason why the C/(Si+C) is set not smaller than 0.61 in the a-SiC surface layer is that, if it is set smaller than 0.61, the a-SiC surface layer may increase in rate of oxidation at its outermost surface because of active species, so that the change in properties, inclusive of oxidation, may be accelerated and hence, the surface layer may increase in quantity of wear.

The C/(Si+C) is set gradually larger from one end portion toward the other end portion of the electrophotographic photosensitive member in the direction of its rotational axis and the end portion having a larger C/(Si+C) is positioned on the air draw-out side, as being done for the following reasons.

In order to make the surface layer less undergo the change in properties due to discharge products as stated above, it is necessary to remove the discharge products by using the air current generation means described above. Since, however, the discharge products come to be much present on the air draw-out side, any electrophotographic photosensitive member having a uniform C/(Si+C) becomes non-uniform in its quantity of wear. Accordingly, also in view of a-SiC characteristics as stated later, the surface layer can be made to wear uniformly by setting the C/(Si+C) gradually larger toward the air draw-out side, where the discharge products are much present.

In this case, as the reason why the surface layer increases in rate of oxidation, it may be noted that the Si atoms have come to be start points and activation centers of oxidation reaction when the a-SiC is oxidized. Hence, where the C/(Si+C) is set smaller than 0.61, in other words, where the Si atoms stand much laid bare to the outermost surface, the oxidation reaction is accelerated and the rate of oxidation increases. As a result, any oxide film formed upon the oxidation of a-SiC commonly has a lowered hardness, and hence the quantity of wear increases through the electrophotographic process.

As the reason why the C/(Si+C) is set not larger than 0.75, it may be considered that the distance between constituent atoms of the a-SiC surface layer is shortened and this makes their mutual binding force higher and makes the porosity in the surface layer decrease. As a result, the probability of reaction due to active species decreases at the surface of the a-SiC surface layer and the oxidation is kept from proceeding, as so considered. Then, any structurally brittle film formed because of the oxidation of the a-SiC surface layer as stated above is kept from being formed, and this brings an improvement in wear resistance of the a-SiC surface layer.

The reason is also that, on the other hand, if the C/(Si+C) is set larger than 0.75, in particular, if a-SiC the C/(Si+C) of which is larger than 0.75 is produced, the durability standing on a high hardness may lower, resulting in an increase in quantity of wear. This is presumed due to the fact that a graphite component increases as the C/(Si+C) becomes larger than 0.75 and hence the surface layer comes to be structurally brittle to decrease in its hardness.

The C/(Si+C) is set within the range of from 0.61 or more to 0.75 or less and the Si+C atom density in the a-SiC surface layer is set to be $6.60\times10^{22}$ atom/cm$^3$ or more. This brings a further improvement in wear resistance of the a-SiC surface layer.

The surface layer 5301 is formed by a vacuum deposited-film forming process and under conditions set appropriately for the numerical values of film formation parameters so that the desired characteristics can be obtained. In view of the productivity of electrophotographic photosensitive members, however, it may preferably be formed by substantially the same deposited-film forming process as that for the photoconductive layer 5202 and charge injection blocking layer 5201.

Materials that can serve as gases for feeding C atoms may include gaseous or gasifiable hydrocarbons such as $CH_4$, $C_2H_6$, $C_3H_8$ and $C_4H_{10}$. In view of readiness to handle and C atoms feed efficiency at the time of film formation, $CH_4$ and $C_2H_6$ are preferred. Also, any of these C-atom-feeding source gases may further optionally be diluted with, e.g., $H_2$ or a rare gas such as He, Ar or Ne when used.

The surface layer 5301 may usually have a layer thickness (film thickness) of from 0.01 μm to 3 μm, preferably from 0.05 μm to 2 μm, and most preferably from 0.1 μm to 1 μm. If the surface layer has a layer thickness (film thickness) of smaller than 0.01 μm, it may become lost because of wear or the like during the use of the electrophotographic photosensitive member. If on the other hand it is larger than 3 μm, a lowering of electrophotographic performance may come because of an increase in residual potential and variations of sensitivity.

Photoconductive Layer

Materials for the photoconductive layer 5202 are materials having sensitivity to light with wavelength at which the electrophotographic photosensitive member is irradiated, and may include materials containing Si atoms. In particular, amorphous materials composed chiefly of Si atoms are preferred. The photoconductive layer may also be incorporated with hydrogen atoms and optionally halogen atoms, in order to improve photoconductivity and charge retentivity.

Charge Injection Blocking Layer

The charge injection blocking layer 5201 has the function to prevent (block) electric charges from being injected from the surface side to the photoconductive layer side when the photosensitive member is subjected to charging in a certain polarity on its free surface, and exhibits no such function when subjected to charging in a reverse polarity, i.e., what is called polarity dependence.

In order to provide such polarity dependence, the charge injection blocking layer 5201 is incorporated with atoms capable of controlling conductivity, in a larger quantity than those in the photoconductive layer 5202.

Next, a flow of deposited-film formation where a-SiC is employed for the charge injection blocking layer 5201, photoconductive layer 5202 and surface layer 5301 is described, taking the case of plasma-assisted CVD.

Deposited-Film Forming Apparatus

Figure 6:
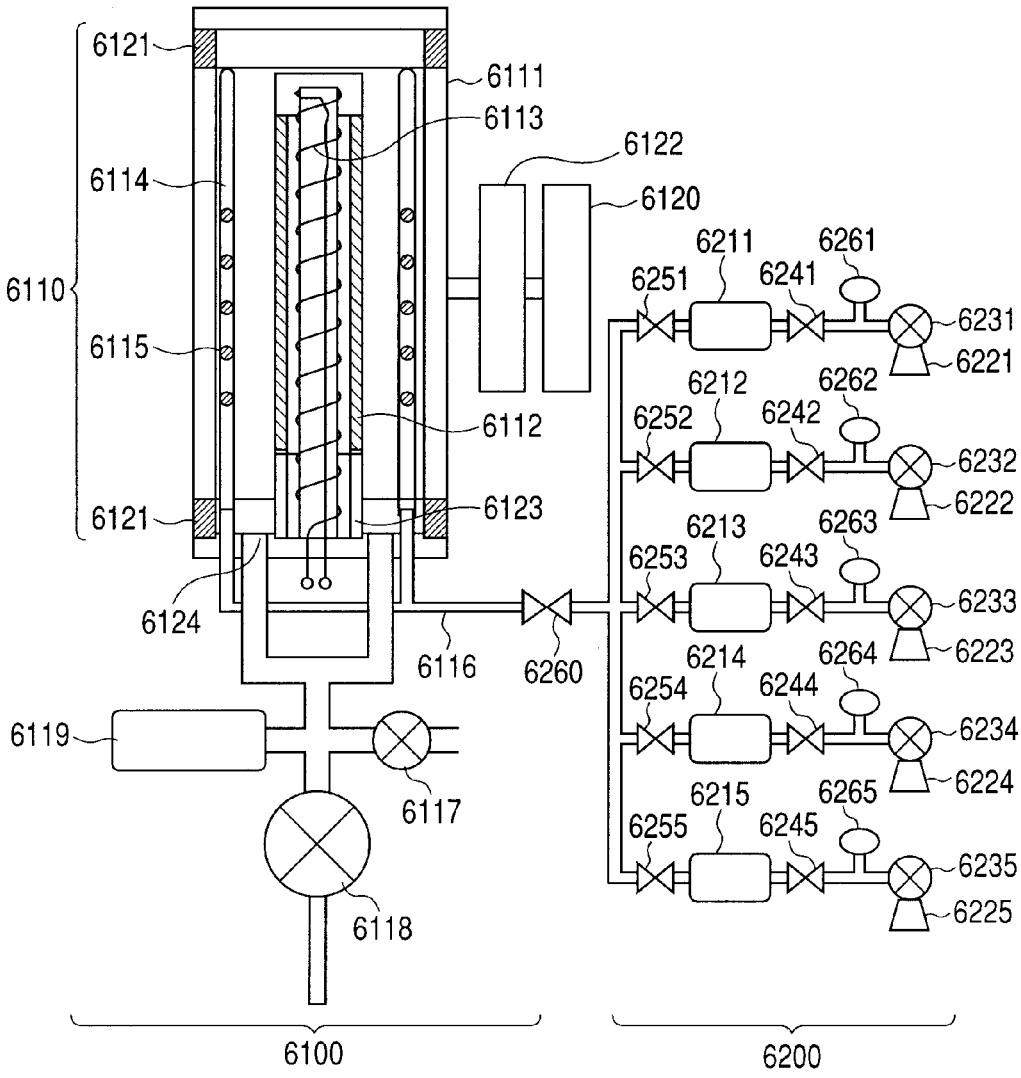
FIG. 6 is a schematic view showing an embodiment of an apparatus for forming deposited films by plasma-assisted CVD, used in the present invention.

FIG. 6 is a diagrammatic view showing an example of an apparatus for forming deposited films by RF plasma-assisted CVD making use of a high-frequency power source, usable to produce the electrophotographic photosensitive member of the present invention.

This apparatus is chiefly constituted of a deposited-film forming system 6100 having a reactor 6110, a source gas feed system 6200 and an exhaust system (not shown) for evacuating the inside of the reactor 6110.

In the reactor 6110, a cylindrical substrate 6112 connected to the ground, a heater 6113 for heating the cylindrical substrate, and a source gas introducing pipe 6114 are placed. A high-frequency power source 6120 is also connected to a cathode electrode 6111, through a high-frequency matching box 6122.

The source gas feed system 6200 has cylinders for source gases such as $SiH_4$, $H_2$, $CH_4$, NO, $B_2H_6$ and $CF_4$, which are source gas cylinders 6221 to 6225. It also has valves 6231 to 6235 as valves for controlling gas flow rates, gas flow-in valves 6241 to 6245 and gas flow-out valves 6251 to 6255. It still also has pressure controllers 6261 to 6265 and mass flow controllers 6211 to 6215.

How to form deposited films by using this apparatus is described next. First, the cylindrical substrate 6112 is placed in the reactor 6110 through a stand 6123. Next, the exhaust system (not shown) is operated to evacuate the inside of the reactor 6110. While watching the indication of a vacuum gauge 6119, the internal pressure of the reactor 6110 is controlled, and, at the time it has come to a stated pressure, e.g., 1 Pa or less, electric power is supplied to the heater 6113 for heating the cylindrical substrate, to heat the cylindrical substrate 6112 to a desired temperature of, e.g., temperature of 100° C. to 350° C. Here, an inert gas such as Ar or He may be fed into the reactor 6110 by means of the gas feed system 6200 to heat the substrate in an atmosphere of inert gas.

Source gases used to form each deposited film are fed into the reactor 6110 by means of the gas feed system 6200 in accordance with each layer, e.g., the charge injection blocking layer, photoconductive layer or surface layer that constitutes the electrophotographic photosensitive member. More specifically, the valves 6231 to 6235, the gas flow-in valves 6241 to 6245 and the gas flow-out valves 6251 to 6255 are opened as occasion calls, and mass flow controllers 6211 to 6215 are made to set gas flow rates. At the time the gas flow rates have become stable at the respective mass flow controllers, a main valve 6118 is operated while watching the indication of the vacuum gauge 6119, to adjust the internal pressure of the reactor 6110 so as to come to the desired pressure. At the time the desired pressure has come, high-frequency power is supplied from the high-frequency power source 6120 and at the same time the high-frequency matching box 6122 is operated to cause plasma discharge to take place inside the reactor 6110. Thereafter, the high-frequency power is immediately adjusted to the desired power, where the deposited film is formed.

Where a multi-layer film is formed, the application of high-frequency power is stopped at the time the deposited film of each layer has come to have the desired layer thickness, and the above procedure may be repeated to form the respective layers. The high-frequency power, the types of source gases, the flow rates thereof, the electric power of the heater 6113 for heating the cylindrical substrate and the internal pressure of the reactor 6110 may continuously again so set as to form the deposited films. For example, source gas flow rates, pressure and so forth may be changed with stated time to the conditions for forming any layer to be formed next, to form an intermediate layer.

Thus, at the time the formation of deposited films for the stated layers has been completed, the application of high-frequency power is stopped. Then, the valves 6231 to 6235, the gas flow-in valves 6241 to 6245, the gas flow-out valves 6251 to 6255 and an auxiliary valve 6260 are closed. Then, at the same time the feeding of source gases is finished, the main valve 6118 is opened to evacuate the inside of the reactor 6110 to a pressure of 1 Pa or less.

After the formation of all deposited films has been completed in this way, the main valve 6118 is closed, where an inert gas is fed into the reactor 6110 to return its internal pressure to atmospheric pressure, and thereafter the cylindrical substrate 6112 with deposited films is taken out.

The foregoing is how to produce the electrophotographic photosensitive member, making use of the formation of deposited films by RF plasma-assisted CVD.

The energy that is to generate plasma may be any of electromagnetic waves of DC, RF, microwave or VHF band regions, any of which may be used in processes for producing electrophotographic photosensitive members in conformity with their desired deposited-film properties.

Then, in the present invention, the proportion of the Si atoms and C atoms constituting the a-SiC layer that is the surface layer of the electrophotographic photosensitive member, more specifically, the ratio of the atom density (C) of carbon atoms to the Si+C atom density in the a-SiC surface layer, C/(Si+C) may be controlled by changing, e.g., the feed rate and/or proportion of the feed gases, Si atom feed gas and C atom feed gas, and the high-frequency power.

Further, in order to change the proportion of the Si atoms and C atoms constituting the a-SiC, in the direction of rotational axis of the electrophotographic photosensitive member, the position or bore diameter of gas introducing openings 6115 of the source gas introducing pipe 6114 shown in FIG. 6 and the position of or gas flow at a discharge outlet 6124 may be changed, for example. Stated specifically, in the apparatus for forming deposited films as shown in FIG. 6, conventionally the gas introducing openings 6115 are commonly so arranged as to keep the distribution of C/(Si+C) uniform. After so made into such a state, in changing the C/(Si+C) in the direction of rotational axis of the electrophotographic photosensitive member, the number of the gas introducing openings 6115 is made less at the portion where the C/(Si+C) is to be made larger. On the other hand, the number of the gas introducing openings 6115 is made larger at the portion where the C/(Si+C) is to be made smaller.

However, specific methods for controlling the C/(Si+C) may differ depending on the deposited-film forming apparatus to be used, the flow rates of gases to be fed, the mixing ratio of gases, the reactor internal pressure, the high-frequency power and so forth, and hence an optimum method may appropriately be used also in the present invention.

In the electrophotographic photosensitive member used in the present invention, it is preferable to control the Si+C atom density of the Si atoms and C atoms constituting the a-SiC, so as to provide a surface layer having film structure with a high atom density.

Where the a-SiC surface layer having a high atom density as in the present invention is formed, it is commonly preferable that the gases to be fed into the reactor are in a smaller quantity and that the high-frequency power is higher. This is because the supplying of high-frequency power in a smaller quantity of gases enables acceleration of the gas decomposition of the feed gases. Then, upon such acceleration of decomposition, the bonding between Si atoms and H atoms and the bonding between C atoms and H atoms are cut, whereby the quantity of H of the a-SiC film is made smaller and the atom density can be made higher.

In addition, ionic components of active species produced by decomposed gases may be made large in quantity, and this facilitates formation of $sp^3$ bonds between Si atoms and C atoms. Similarly, making such ionic components large in quantity can reduce any π bonds produced during the formation of deposited films. As the result, because of such reduction of π bonds which form plane components to give steric hindrance, a denser stereostructure is formed to make the atom density higher. Further, because of a high reactivity of such π bonds, the reduction of π bonds brings a state that is stable also chemically.

Further, the substrate may be made to have a high temperature in the course of forming the deposited films, and this enables control of equilibrium between a deposition course and a dissociation course to lower the rate of deposition to form a dense film having been made stable as stated above, and consequently the atom density can be made higher.

The electrophotographic photosensitive member thus produced may be not only used for electrophotographic copying machines, but also widely used for laser beam printers, CRT printers, LED printers, liquid-crystal printers, and laser plate-making.

EXAMPLES

The present invention is described below in greater detail by giving Examples and Comparative Examples, to which, however, the present invention is by no means limited.

Example 1

First, by means of the plasma-assisted treating apparatus shown in FIG. 6, making use of a high-frequency power source and using an RF band as its frequency, deposited films were formed on a cylindrical substrate (a conductive substrate of 80 mm in diameter, 358 mm in length and 3 mm in wall thickness which was cylindrical and made of aluminum and the surface of which was mirror-finished) to produce an electrophotographic photosensitive member.

In producing it, in order to form the surface layer the C/(Si+C) of which was to become gradually larger from one end portion toward the other end portion of the electrophotographic photosensitive member, the position of the gas introducing openings 6115 of the source gas introducing pipe 6114 shown in FIG. 6 was adjusted. The position of the gas introducing openings 6115 was adjusted by reducing the number of gas introducing openings 6115 on the end portion side (lower part of the source gas introducing pipe in FIG. 6) where the C/(Si+C) was to be set larger with respect to the position where the C/(Si+C) was to stand distributed uniformly (hereinafter termed "standard position"). To be more specific, this example prepared two types of source gas introducing pipes, i.e., one type including 4 source gas introducing pipes having 36 gas introducing openings provided from the top to the bottom at substantially equal intervals and the other type including 4 source gas introducing pipes having 6 gas introducing openings in the upper half and 1 gas introducing opening in the lower half. A total of 8 source gas introducing pipes were placed in a reactor in such a manner that the cylindrical substrate was surrounded by the source gas introducing pipes with the two types of source gas introducing pipes alternately arranged.

In forming the deposited films, a charge injection blocking layer, a photoconductive layer and a surface layer were formed in this order under conditions of substrate temperature, reactor internal pressure, high-frequency power, $SiH_4$ flow rate, $H_2$ flow rate, $B_2H_6$ flow rate, NO flow rate and $CH_4$ flow rate at the time of forming each layer, as shown in Table 1 below.

As the number of the electrophotographic photosensitive member produced, two members were produced under the same film forming conditions (layer forming conditions).

TABLE 1

| | Charge injection blocking layer | Photo-conductive layer | Surface layer |
|---|---|---|---|
| Gases & gas flow rates: | | | |
| $SiH_4$ (ml/min) (normal) | 300 | 400 | 25 |
| $H_2$ (ml/min) (normal) | 650 | 2,100 | — |
| $B_2H_6$ (ppm based on $SiH_4$) | 2,000 | 3 | — |
| NO (ml/min) (normal) | 5 | — | — |
| $CH_4$ (ml/min) (normal) | — | — | 260 |
| Substrate temperature (° C.) | 250 | 250 | 260 |
| Reactor internal pressure (Pa) | 40 | 75 | 80 |
| High-frequency power (kW) | 0.4 | 0.8 | 0.3 |
| Layer thickness (μm) | 3 | 30 | 1 |

One member of the two electrophotographic photosensitive members produced in Example 1 was used to make analysis thereon. In making the analysis, the surface of the electrophotographic photosensitive member was divided into five regions in the direction of its rotational axis.

Stated specifically, the position of one end portion was designated as A and the position of the other end portion as B, where the member surface was divided into five equal portions to provide the five regions. As to the equally divided regions, the region inclusive of the end portion A was designated as No. 1 and the region inclusive of the end portion B as No. 5, where the region adjoining to the region No. 1 was designated as No. 2 and the remaining regions as No. 3 and No. 4 in order, toward the region No. 5.

Then, about these five regions, an analytical method described later was carried out at any arbitrary three spots for each region. Thereafter, about the data of C/(Si+C), Si atom density, C atom density and Si+C atom density which were obtained at the arbitrary three spots, their average values were calculated to find the respective values for each region.

The analytical methods for the C/(Si+C), Si atom density, C atom density and Si+C atom density are shown below.

Measurement of C/(Si+C), measurement of Si atom density, measurement of C atom density and measurement of Si+C atom density First, a reference electrophotographic photosensitive member was produced in which only the charge injection blocking layer and photoconductive layer shown in Table 1 were formed. Then, this was cut out in a square shape of 15 mm square at a middle portion thereof in its lengthwise direction at its arbitrary position in peripheral direction to prepare a reference sample. Next, the electrophotographic photosensitive member in which the charge injection blocking layer, the photoconductive layer and the surface layer were formed was likewise cut out to prepare a sample for measurement. The reference sample and the sample for measurement were measured by spectroscopic ellipsometry (using a high-speed spectroscopic ellipsometer M-2000, manufactured by J.A. Woollam Co., Inc.) to determine the layer thickness of the surface layer.

Specific conditions for the measurement by spectroscopic ellipsometry are incident angles: 60°, 65° and 70°; measurement wavelength: 195 nm to 700 nm; and beam diameter: 1 mm×2 mm.

First, the reference sample was measured by the spectroscopic ellipsometry to find the relationship between the wavelength and the amplitude ratio ψ and phase difference Δ at each incident angle.

Next, taking as a reference the results of measurement on the reference sample, the sample for measurement was measured in the same way as the reference sample by spectroscopic ellipsometry to determine the relationship between the wavelength and the amplitude ratio ψ and phase difference Δ at each incident angle.

Further, a layer structure in which the charge injection blocking layer, the photoconductive layer and the surface layer were formed in this order and which had a roughness layer where the surface layer and a pneumatic layer were present together at the outermost surface was used as a calculation model. Using this model, and changing in volume ratio the surface layer and pneumatic layer of the roughness layer, the relationship between the wavelength and the amplitude ratio ψ and phase difference Δ at each incident angle was found by calculation, using an analytical software. Then, a calculation model was picked out on which the relationship between the wavelength and the amplitude ratio ψ and phase difference Δ at each incident angle that was found by this calculation and the relationship between the wavelength and the amplitude ratio ψ and phase difference Δ at each incident angle that was found by measuring the sample for measurement came minimal in their mean square error. The layer thickness of the surface layer was calculated according to the calculation model thus picked out, and the value obtained was taken as the layer thickness of the surface layer.

Here, WVASE 32, available from J.A. Woollam Co., Inc., was used as the analytical software. Also, in regard to the volume ratio of the surface layer and pneumatic layer of the roughness layer, the proportion of the pneumatic layer in the roughness layer, surface layer:pneumatic layer, was changed at intervals of 1 from 10:0 to 1:9 to make calculation. Then, about the relationship between the wavelength and the amplitude ratio ψ and phase difference Δ at each incident angle on the calculation model and the relationship between the wavelength and the amplitude ratio ψ and phase difference Δ at each incident angle that was found by measurement, the minimal in their mean square error was searched. In the positive-charging a-Si photosensitive member produced in the present Example under the respective film forming conditions, the mean square error came minimal when the surface layer and the pneumatic layer were 8:2 in their volume ratio.

After the measurement made by spectroscopic ellipsometry was finished, the number of atoms of Si atoms and number of atoms of C atoms in the surface layer within the area of measurement by RBS was measured. The above sample for measurement was measured by RBS (Rutherford back scattering, using a back scattering analyzer AN-2500, manufactured by Nisshin High Voltage Co., Ltd.).

The C/(Si+C) was found from the number of atoms of Si atoms and number of atoms of C atoms thus measured. Next, the Si atom density, the C atom density and the Si+C atom density were determined by using the number of atoms of Si atoms and the number of atoms of C atoms, obtained from the measurement by RBS, the area of measurement by RBS, and the layer thickness of surface layer that was determined by spectroscopic ellipsometry.

The values of the C/(Si+C), Si atom density, C atom density and Si+C atom density which were calculated for each of the five regions from the values obtained by making analysis as above are shown in Table 2 below. About the respective values of physical properties, average values in the five regions were calculated to take them as average values under the corresponding conditions for film formation.

TABLE 2

| | Average values | Regions No. 1 | No. 2 | No. 3 | No. 4 | No. 5 |
|---|---|---|---|---|---|---|
| C/(Si + C) | 0.63 | 0.61 | 0.62 | 0.63 | 0.64 | 0.65 |
| C atom density ($\times 10^{22}$ atom/cm$^3$) | 3.98 | 3.82 | 3.89 | 3.99 | 4.06 | 4.15 |
| Si atom density ($\times 10^{22}$ atom/cm$^3$) | 2.34 | 2.44 | 2.38 | 2.35 | 2.29 | 2.23 |
| Si + C atom density ($\times 10^{22}$ atom/cm$^3$) | 6.32 | 6.26 | 6.27 | 6.34 | 6.35 | 6.38 |

As is clear from Table 2, the C/(Si+C) at any arbitrary spots in the respective equally divided regions in the direction of rotational axis of the electrophotographic photosensitive member stood gradually larger from No. 1 toward No. 5. The average value of the Si+C atom density came to $6.32\times10^{22}$ atom/cm$^3$.

Next, another electrophotographic photosensitive member, other than that for the analysis, was placed in the electrophotographic apparatus shown in FIG. 1, in such a way that the end portion where the C/(Si+C) was larger was set on the side of the air draw-out fan 216 shown in FIG. 2, and wear quantity evaluation and image evaluation were made by methods described later.

Comparative Example 1

In Comparative Example 1, an electrophotographic photosensitive member was so produced that the C/(Si+C) was 0.61 or more and the C/(Si+C) was substantially uniform in the direction of its rotational axis. Stated specifically, the position of the gas introducing openings 6115 shown in FIG. 6 was made different from that in Example 1, and an electrophotographic photosensitive member was produced by means of the plasma-assisted treating apparatus shown in FIG. 6. The position of the gas introducing openings 6115 was returned to the standard position from the position which was so set as in Example 1 that the C/(Si+C) became gradually larger. The films were formed under the same conditions as those shown in Table 2. As the number of the electrophotographic photosensitive member, two members in total were produced, and one member was used for analysis, and one member for wear quantity evaluation.

Then, in the same way as in Example 1, one member of the electrophotographic photosensitive member produced was used to make the same analysis as that in Example 1 about the five equally divided regions in the direction of rotational axis to find the values of the C/(Si+C), Si atom density, C atom density and Si+C atom density in each region. Results obtained are shown in Table 3 below.

TABLE 3

| | Average values | Regions No. 1 | No. 2 | No. 3 | No. 4 | No. 5 |
|---|---|---|---|---|---|---|
| C/(Si + C) | 0.61 | 0.61 | 0.62 | 0.61 | 0.61 | 0.61 |
| C atom density ($\times 10^{22}$ atom/cm$^3$) | 3.87 | 3.86 | 3.93 | 3.87 | 3.85 | 3.83 |
| Si atom density ($\times 10^{22}$ atom/cm$^3$) | 2.45 | 2.46 | 2.41 | 2.48 | 2.46 | 2.45 |
| Si + C atom density ($\times 10^{22}$ atom/cm$^3$) | 6.32 | 6.32 | 6.34 | 6.35 | 6.31 | 6.28 |

As shown in Table 3, the electrophotographic photosensitive member of Comparative Example 1 was an electrophotographic photosensitive member showing less differences between the respective regions of from No. 1 to No. 5 and having substantially uniform C/(Si+C) showing a small gradient in the direction of rotational axis. About the C/(Si+C) at any arbitrary spots in the respective equally divided regions in the direction of rotational axis of the electrophotographic photosensitive member, it showed a tendency to differ from the tendency of becoming gradually larger like that in Example 1. The average value of the Si+C atom density also came to $6.32\times10^{22}$ atom/cm$^3$.

Next, about the electrophotographic photosensitive members for wear quantity evaluation, wear quantity evaluation was made in the following way.

Wear Quantity Evaluation

The quantity of wear was evaluated according to the following procedure.

First, the layer thickness of the surface layer in each electrophotographic photosensitive member standing immediately after its production was measured at a plurality of spots in the direction of its rotational axis by a method described later, and the layer thickness calculated was taken as initial-stage layer thickness. Thereafter, a continuous paper feed test was conducted using a test machine described later, and the layer thickness of the surface layer was measured at the same spots as those for the initial-stage layer thickness, and the layer thickness calculated was taken as after-test layer thickness. Then, a difference between the initial-stage layer thickness and the after-test layer thickness thus found by calculation was taken as the quantity of wear. Also, a difference between the maximum value and the minimum value among quantities of wear measured and calculated at the plurality of spots in the direction of rotational axis was taken as wear quantity non-uniformity. Detailed methods are shown below.

The layer thickness of the surface layer was measured in the following way.

As a measuring method, the surface of the electrophotographic photosensitive member was vertically irradiated with light in a spot diameter of 2 mm, and the reflected light was measure by spectrometry using a spectrometer (MCPD-2000, manufactured by Otuska Electronics Co., Ltd.). The layer thickness of the surface layer was calculated on the basis of reflection waveforms obtained. Here, the wavelength range was from 500 nm to 750 nm, the photoconductive layer had a refractive index of 3.30, and, as a refractive index of the surface layer, the value found by the measurement by spectroscopic ellipsometry was used which was made when the Si+C atom density was measured as described previously.

The above measurement was made on the equally divided five regions described previously, and at three spots at substantially regular intervals in the direction of rotational axis for each region, and an average value of the values of measurement at the three spots was taken as the layer thickness of the surface layer in each region.

The continuous paper feed test was conducted in the following way.

The electrophotographic photosensitive member on which the initial-stage layer thickness had been measured was placed in a conversion apparatus of a digital electrophotographic apparatus "iRC-5065" (trade name), manufactured by CANON INC, having the air current generation unit shown in FIG. 1. In order to inspect the effect of the air current generation means, the apparatus was converted in such a way that any air current generation source other than the air current generation unit described above was stopped. Also, any turbulence of air current that was due to the rotation of the electrophotographic photosensitive member was assumed to be under the same conditions by making the rotational speed of the electrophotographic photosensitive member constant for each test.

Figure 7:
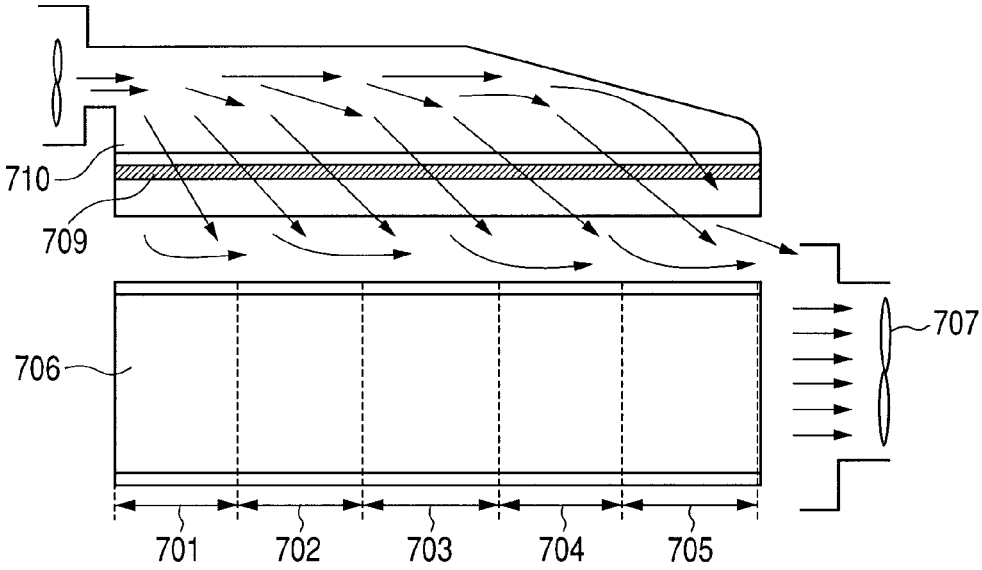
FIG. 7 is a schematic view showing regional divisions referred to in Example 1.
Figure 8:
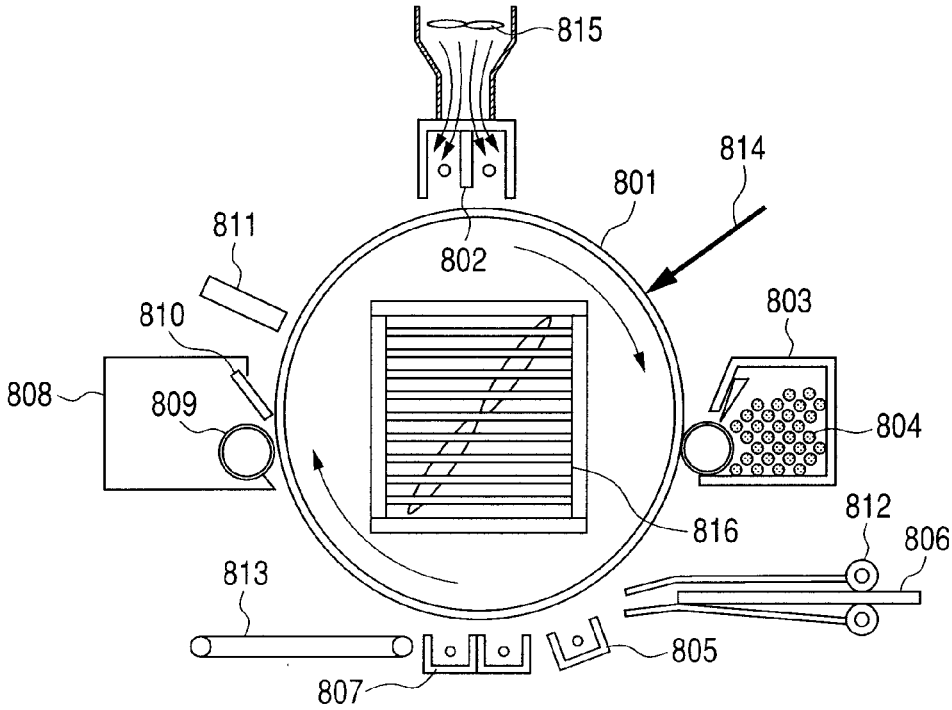
FIG. 8 is a schematic view of an electrophotographic apparatus used in Examples 3 to 5.

The electrophotographic photosensitive member was placed in the apparatus in the manner as shown in FIG. 8. In Example 1, as is seen from Table 2, the electrophotographic photosensitive member of the present invention was used in which the C/(Si+C) stood gradually larger from one end portion toward the other end portion of the photosensitive member in the direction of its rotational axis. It was so placed that the end portion No. 1 having a smaller C/(Si+C), shown in FIG. 2, was made to correspond to the region 701 shown in FIG. 7 and that the end portion No. 5 having a larger C/(Si+C) was positioned on the side of an air draw-out fan 707 shown in FIG. 7.

In Comparative Example 1 as well, in which the C/(Si+C) was substantially uniform, the region No. 5 shown in Table 3 was positioned on the side of the air draw-out fan 707 like Example 1.

After the electrophotographic photosensitive member was placed in the apparatus as above, a 400,000-sheet continuous paper feed test was conducted as the continuous paper feed test in a high-humidity environment of 25° C. temperature and 75% relative humidity.

After the 400,000-sheet continuous paper feed test was finished, the electrophotographic photosensitive member was taken out of the electrophotographic apparatus, where the layer thickness was measured at the same positions as that immediately after production as described previously, and the layer thickness of the surface layer was calculated to find the after-test layer thickness.

The quantity of wear was evaluated in the following way.

The difference between the initial-stage layer thickness and the after-test layer thickness which were obtained from the measurement of layer thickness which was made before and after the continuous paper feed test was found in the respective equally divided five regions described previously, and the quantities of wear in the 400,000-sheet continuous paper feed test were calculated for each region. An average quantity of wear was also calculated from the quantities of wear in the five regions, thus calculated. Further, the quantities of wear in the respective five equally divided regions were compared to calculate the difference between the maximum value and the minimum value among them, to calculate the wear quantity non-uniformity. Then, about the quantity of wear, average quantity of wear and wear quantity non-uniformity in the five regions, thus calculated, a proportion found when Comparative Example 1 was regarded as a standard and each value of Comparative Example 1 was taken as the denominator was calculated for each item to make evaluation. Accordingly, the quantity of wear, average quantity of wear and wear quantity non-uniformity were judged to turn better than those of Comparative Example 1 when each value calculated was smaller than 1.

Image Evaluation

Image evaluation was made in the following way.

To make image evaluation, image density non-uniformity in halftone images before the continuous paper feed test and image density non-uniformity in halftone images after the continuous paper feed test were compared to inspect variations in image density non-uniformity.

As an evaluation method, about halftone images, their image densities were measured with a reflection densitometer (X-Rite 504, a spectral densitometer manufactured by X-Rite Inc.) at image positions corresponding to the above respective five regions and at any arbitrary three spots for each region, and an average value of these densities was taken as density for each region. A difference between the maximum density and the minimum density in the five regions was taken as the image density non-uniformity. Then, a difference between image density non-uniformity before the continuous paper feed test and that after the continuous paper feed test was taken as image density non-uniformity variation.

The image density non-uniformity variation was judged according to the following criteria.

AA: Less than 0.01 (excellent).

A: From 0.01 or more to less than 0.02 (good).

B: From 0.02 or more to less than 0.03 (passable).

C: 0.03 or more (failure).

The results of the wear quantity evaluation and image evaluation in Example 1 and Comparative Example 1 are shown in Table 4 below.

TABLE 4

| | Average quantity of wear | Wear quantity non-uniformity | Wear quantity in each region | | | | | Image evaluation |
|---|---|---|---|---|---|---|---|---|
| | | | Region No. 1 | Region No. 2 | Region No. 3 | Region No. 4 | Region No. 5 | |
| Example: | | | | | | | | |
| 1 | 0.92 | 0.13 | 1.01 | 1.05 | 0.97 | 0.86 | 0.78 | AA |
| 2 | 0.70 | 0.22 | 0.73 | 0.78 | 0.79 | 0.67 | 0.59 | AA |
| 3 | 0.83 | 0.20 | 0.90 | 0.91 | 0.90 | 0.79 | 0.70 | AA |
| 4 | 0.60 | 0.31 | 0.63 | 0.63 | 0.66 | 0.57 | 0.54 | AA |
| 5 | 0.62 | 0.24 | 0.68 | 0.72 | 0.63 | 0.55 | 0.55 | AA |
| 6 | 0.56 | 0.20 | 0.57 | 0.66 | 0.61 | 0.54 | 0.48 | AA |
| 7 | 0.52 | 0.13 | 0.55 | 0.61 | 0.56 | 0.48 | 0.45 | AA |
| 8 | 0.46 | 0.27 | 0.49 | 0.57 | 0.51 | 0.45 | 0.33 | AA |
| Comparative Example: | | | | | | | | |
| 1 | 1.00 | 1.00 | 1.00 | 1.00 | 1.00 | 1.00 | 1.00 | B |
| 2 | 1.18 | 0.12 | 1.28 | 1.35 | 1.28 | 1.10 | 0.98 | A |
| 3 | 1.12 | 0.39 | 1.18 | 1.23 | 1.20 | 1.06 | 1.00 | A |
| 4 | 1.12 | 0.33 | 1.19 | 1.25 | 1.20 | 1.05 | 0.99 | A |
| 5 | 0.99 | 1.21 | 0.89 | 0.98 | 1.02 | 1.05 | 1.01 | C |

As is clear from the results shown in Table 4, in Example 1, making use of the electrophotographic photosensitive member in which the C/(Si+C) stood gradually larger from one end portion toward the other end portion of the photosensitive member in the direction of its rotational axis, it was seen that the wear quantity non-uniformity was reduced when compared with Comparative Example 1, in which the distribution of the C/(Si+C) was substantially uniform. It was also seen that the image density non-uniformity was kept from varying.

This is considered due to the fact that, under the uniform distribution of C/(Si+C), the discharge products come to be much present on the air draw-out side when the air current generation means was used as described above, so that the quantity of wear increases on that side to cause non-uniformity in quantity of wear. However, setting the C/(Si+C) gradually larger toward the air draw-out side as in Example 1 reduces the quantity of wear on the air draw-out side, so that the quantity of wear can be made less non-uniform, as so considered.

From this, it is seen that setting the C/(Si+C) gradually larger toward the air draw-out side of the air current generation means is effective in keeping the wear quantity non-uniformity from coming and can keep images well.

Comparative Example 2

One electrophotographic photosensitive member was produced under entirely the same film forming conditions as those in Comparative Example 1. The electrophotographic photosensitive member produced was placed in an electrophotographic apparatus in the same way as in Example 1 and Comparative Example 1; the electrophotographic apparatus having been converted in the same way except that a conversion electrophotographic apparatus as shown in FIG. 1 was not provided with any air current generation means, and the wear quantity evaluation and the image evaluation were made in the same way as those in Comparative Example 1.

Results obtained are shown in Table 4 above, together with the results of Example 1 and Comparative Example 1.

As is clear from the results shown in Table 4, in Comparative Example 2, in which the apparatus was not provided with any air current generation means, it was seen that the wear quantity non-uniformity was less than that in Comparative Example 1 but the average quantity of wear came larger than that. It was also seen that, in Comparative Example 1, having the air current generation means, the quantity of wear was larger in the region No. 5, positioned on the air draw-out side, than the region No. 1 on the opposite side.

This is considered due to the fact that, in the case in which any air current generation means was not provided, the discharge products stayed inside the electrophotographic apparatus to come to be in a high concentration and this accelerated the change in properties of the surface of the electrophotographic photosensitive member, resulting in an increase in the quantity of wear.

From this, it has been ascertained that the air current generation means is important in reducing the quantity of wear.

Example 2

An electrophotographic photosensitive member was so produced that the C/(Si+C) came larger than that in Example 1 when the respective regions in Example 1 were compared with those in this Example, respectively. In its production, the plasma-assisted treating apparatus shown in FIG. 6, the position of the gas introducing openings 6115 of which was adjusted, was used to produce the electrophotographic photosensitive member. As film forming conditions, the charge injection blocking layer and the photoconductive layer were formed under the same conditions as those in Example 1 and the surface layer was formed under conditions shown in Table 5 below. As the electrophotographic photosensitive member, two members were produced under the same film forming conditions (layer forming conditions).

TABLE 5

| | Example | | | Comparative Example | |
|---|---|---|---|---|---|
| | 2 | 5 | 6 | 3 | 4 |
| Gases & gas flow rates: | | | | | |
| $SiH_4$ (ml/min) (normal) | 26 | 26 | 26 | 30 | 20 |
| $H_2$ (ml/min) (normal) | — | — | — | — | — |
| $B_2H_6$ (ppm based on $SiH_4$) | — | — | — | — | — |
| NO (ml/min) (normal) | — | — | — | — | — |
| $CH_4$ (ml/min) (normal) | 450 | 500 | 350 | 1,500 | 650 |
| Substrate temperature (° C.) | 260 | 260 | 260 | 260 | 260 |
| Reactor internal pressure (Pa) | 80 | 80 | 80 | 80 | 80 |
| High-frequency power (kW) | 0.7 | 0.8 | 1 | 0.35 | 0.9 |
| Layer thickness (μm) | 1 | 1 | 1 | 1 | 1 |

In the same way as in Example 1, one member of the electrophotographic photosensitive members thus produced was used to make analysis on the five equally divided regions in the direction of rotational axis to calculate the values of the C/(Si+C), Si atom density, C atom density and Si+C atom density in each region. Results obtained are shown in Table 6 below.

TABLE 6

| | Average values | Regions No. 1 | No. 2 | No. 3 | No. 4 | No. 5 |
|---|---|---|---|---|---|---|
| C/(Si + C) | 0.72 | 0.69 | 0.71 | 0.72 | 0.73 | 0.75 |
| C atom density ($\times 10^{22}$ atom/cm$^3$) | 4.60 | 4.39 | 4.50 | 4.59 | 4.70 | 4.82 |
| Si atom density ($\times 10^{22}$ atom/cm$^3$) | 1.79 | 1.97 | 1.84 | 1.79 | 1.74 | 1.61 |
| Si + C atom density ($\times 10^{22}$ atom/cm$^3$) | 6.39 | 6.36 | 6.34 | 6.38 | 6.44 | 6.43 |

As is clear from Table 6, like Example 1, the C/(Si+C) at any arbitrary spots in the respective equally divided regions in the direction of rotational axis of the electrophotographic photosensitive member stood gradually larger from No. 1 toward No. 5. Here, the average value of the Si+C atom density came to $6.39\times10^{22}$ atom/cm$^3$.

About the electrophotographic photosensitive member of Example 2, thus produced, the wear quantity evaluation and the image evaluation were made in the same manner of placement, by using the same conversion electrophotographic apparatus and under the same evaluation conditions as those in Example 1. Results obtained are shown in Table 4 above.

As is clear from Table 4, even in the case when the C/(Si+C) was set larger in all the regions than that in Example 1 and set to be 0.75 or less, the wear quantity non-uniformity was reduced in the electrophotographic photosensitive member in which the C/(Si+C) stood gradually larger from one end portion toward the other end portion in the direction of its rotational axis. It was also seen that the image density non-uniformity was kept from varying.

From this and putting that in Example 1 together, the following effect is seen to be obtainable. That is, the wear quantity non-uniformity can be reduced by using the electrophotographic photosensitive member in which the C/(Si+C) of a-SiC is within the range of from 0.61 or more to 0.75 or less and the C/(Si+C) stands gradually larger from one end portion toward the other end portion of the photosensitive member and also by positioning on the air draw-out side the end portion where the C/(Si+C) is larger. Then, it is seen that making the C/(Si+C) gradually larger toward the air draw-out side of the air current generation means is effective in keeping the wear quantity non-uniformity from coming and can keep images well.

Comparative Example 3

As Comparative Example 3, an electrophotographic photosensitive member was so produced that the C/(Si+C) came smaller than that in Example 1 when the respective regions in Example 1 were compared with those in this Comparative Example, respectively. In its production, the plasma-assisted treating apparatus shown in FIG. 6, the position of the gas introducing openings 6115 of which was adjusted, was used to produce the electrophotographic photosensitive member. As film forming conditions, the charge injection blocking layer and the photoconductive layer were formed under the same conditions as those in Example 1 and the surface layer was formed under conditions shown in Table 5 above. As the electrophotographic photosensitive member, two members were produced under the same film forming conditions (layer forming conditions).

In the same way as in Example 1, one member of the electrophotographic photosensitive members thus produced was used to make analysis on the five equally divided regions in the direction of rotational axis to calculate the values of the C/(Si+C), Si atom density, C atom density and Si+C atom density in each region. Results obtained are shown in Table 7 below.

TABLE 7

| | Average values | Regions No. 1 | No. 2 | No. 3 | No. 4 | No. 5 |
|---|---|---|---|---|---|---|
| C/(Si + C) | 0.56 | 0.53 | 0.54 | 0.56 | 0.57 | 0.59 |
| C atom density ($\times 10^{22}$ atom/cm$^3$) | 3.40 | 3.20 | 3.28 | 3.41 | 3.48 | 3.61 |
| Si atom density ($\times 10^{22}$ atom/cm$^3$) | 2.69 | 2.83 | 2.79 | 2.68 | 2.63 | 2.51 |
| Si + C atom density ($\times 10^{22}$ atom/cm$^3$) | 6.08 | 6.03 | 6.07 | 6.09 | 6.11 | 6.12 |

As is seen from Table 7, like Example 1, the C/(Si+C) at any arbitrary spots in the respective equally divided regions in the direction of rotational axis of the electrophotographic photosensitive member stood gradually larger from No. 1 toward No. 5. Here, the average value of the Si+C atom density came to $6.08\times10^{22}$ atom/cm$^3$.

About the electrophotographic photosensitive member of Comparative Example 3, thus produced, the wear quantity evaluation and the image evaluation were made in the same manner of placement, by using the same conversion electrophotographic apparatus and under the same evaluation conditions as those in Example 1. Results obtained are shown in Table 4 above.

As is clear from Table 4, where the average value of the C/(Si+C) was set to be 0.56, the wear quantity non-uniformity was also reduced in the electrophotographic photosensitive member in which the C/(Si+C) stood gradually larger from one end portion toward the other end portion in the direction of its rotational axis, like Example 1. It was also seen that the image density non-uniformity was kept from varying. It, however, was seen that the average quantity of wear came large. This is considered due to the fact that the Si atoms serving as starting points of the reaction to be caused by the discharge products came high in proportion and hence the change in properties was accelerated.

From this, it is seen that it is important for the C/(Si+C) to be within the range of 0.61 or more.

Comparative Example 4

An electrophotographic photosensitive member was so produced that the C/(Si+C) came larger than that in Example 2 when the respective regions in Example 2 were compared with those in this Comparative Example, respectively. In its production, the plasma-assisted treating apparatus shown in FIG. 6, the position of the gas introducing openings 6115 of which was adjusted, was used to produce the electrophotographic photosensitive member. As film forming conditions, the charge injection blocking layer and the photoconductive layer were formed under the same conditions as those in Example 1 and the surface layer was formed under conditions shown in Table 5 above. As the electrophotographic photosensitive member, two members were produced under the same film forming conditions (layer forming conditions).

In the same way as in Example 1, one member of the electrophotographic photosensitive members thus produced was used to make analysis on the five equally divided regions in the direction of rotational axis to calculate the values of the C/(Si+C), Si atom density, C atom density and Si+C atom density in each region. Results obtained are shown in Table 8 below.

TABLE 8

| | Average values | Regions No. 1 | No. 2 | No. 3 | No. 4 | No. 5 |
|---|---|---|---|---|---|---|
| C/(Si + C) | 0.83 | 0.81 | 0.82 | 0.84 | 0.85 | 0.86 |
| C atom density ($\times 10^{22}$ atom/cm$^3$) | 5.42 | 5.13 | 5.30 | 5.50 | 5.58 | 5.62 |
| Si atom density ($\times 10^{22}$ atom/cm$^3$) | 1.11 | 1.36 | 1.24 | 1.05 | 0.98 | 0.91 |
| Si + C atom density ($\times 10^{22}$ atom/cm$^3$) | 6.53 | 6.49 | 6.54 | 6.55 | 6.56 | 6.53 |

As is seen from Table 8, like Example 1, the C/(Si+C) at any arbitrary spots in the respective equally divided regions in the direction of rotational axis of the electrophotographic photosensitive member stood gradually larger from No. 1 toward No. 5. Here, the average value of the Si+C atom density came to $6.53\times10^{22}$ atom/cm$^3$.

About the electrophotographic photosensitive member of Comparative Example 4, thus produced, the wear quantity evaluation and the image evaluation were made in the same manner of placement, by using the same conversion electrophotographic apparatus and under the same evaluation conditions as those in Example 1. Results obtained are shown in Table 4 above.

As is clear from Table 4, even where the average value of the C/(Si+C) was set to be as large as 0.83, the following effect was seen to be obtainable like Example 1. That is, the wear quantity non-uniformity was also reduced in the electrophotographic photosensitive member in which the C/(Si+C) stood gradually larger from one end portion toward the other end portion in the direction of its rotational axis. It, however, was seen that the average quantity of wear came large like that in Comparative Example 3. This is considered to be that the average quantity of wear came large because the Si+C atom density was at approximately the like level throughout the respective regions and the C atoms came too high in proportion to make the graphite component increase.

From this, it is seen that it is important for the C/(Si+C) to be within the range of 0.75 or less.

Comparative Example 5

Using an electrophotographic photosensitive member produced under entirely the same conditions as those in Example 1, the wear quantity evaluation was made by using the same conversion electrophotographic apparatus and under the same evaluation conditions as those in Example 1 except that only the manner of placement of the photosensitive member was changed.

The electrophotographic photosensitive member was so placed as to be in region arrangement reverse to that in Example 1, i.e., that the region No. 1, where the C/(Si+C) was smaller, was positioned on the side of the air draw-out fan 707 shown in FIG. 7. Thus, it was so placed that that the region No. 5, where the C/(Si+C) was larger, was positioned correspondingly to the region 701, which was distant from the air draw-out side. The results of the wear quantity evaluation and image evaluation made in this case are shown in Table 4 above.

As is clear from the results shown in Table 4, it was seen that the wear quantity non-uniformity came large when the end portion side where the C/(Si+C) was smaller was positioned on the side of the air draw-out fan. It was also seen that the image density non-uniformity varied greatly.

This is considered to be that the quantity of wear on the air draw-out side came large because the end portion side where the C/(Si+C) was smaller was positioned on the side where the discharge products were much present and further that the wear quantity non-uniformity came large because the quantity of wear on the other end portion was small.

From this, it is seen that the directions of distribution of C/(Si+C) and air draw-out are important.

Example 3

In Example 3, using an electrophotographic photosensitive member produced under entirely the same conditions as those in Example 1, the wear quantity evaluation and the image evaluation were made in the same way as in Example 1 except that the conversion electrophotographic apparatus used therein was changed for the electrophotographic apparatus shown in FIG. 8. Here, the electrophotographic apparatus shown in FIG. 8 is an apparatus having been so converted that an air current generation means 815 makes the air pass through the inside of a charging member 802 facing the surface of an electrophotographic photosensitive member 801 and thereafter blow over the surface of the electrophotographic photosensitive member 801.

The results of the wear quantity evaluation and image evaluation are shown in Table 4 above.

As is clear from the results shown in Table 4, it was seen that the average quantity of wear was reduced by making the air current generation means pass the air through the inside of the charging member facing the surface of the electrophotographic photosensitive member and thereafter blow over the surface of the electrophotographic photosensitive member. In addition, the image density non-uniformity was kept from varying.

This is considered due to the fact that the blowing of the air after it passed through the inside of the charging member enabled the discharge products to be effectively removed from the discharge part where the discharge products most tend to stay. From this, it is seen that it is important to blow the air after it has passed through the inside of the charging member or to blow the air from the surface of the charging member.

Example 4

Using an electrophotographic photosensitive member produced under entirely the same conditions as those in Example 2, the wear quantity evaluation and the image evaluation were made in the same way as in Example 3, using the same conversion electrophotographic apparatus as that in Example 3. The results of the wear quantity evaluation and image evaluation are shown in Table 4 above.

From the results shown in Table 4, like Example 3, it was seen that the average quantity of wear was reduced by making the air current generation means pass the air through the inside of the charging member facing the surface of the electrophotographic photosensitive member and thereafter blow over the surface of the electrophotographic photosensitive member. In addition, the image density non-uniformity was kept from varying.

Example 5

An electrophotographic photosensitive member was so produced that the C/(Si+C) came to from 0.61 or more to 0.75 or less in its whole region and the average value of the Si+C atom density came to about $6.60\times10^{22}$ atom/cm$^3$. The electrophotographic photosensitive member was produced with adjustment of the position of the gas introducing openings 6115 shown in FIG. 6 and by using the plasma-assisted treating apparatus shown in FIG. 6. As film forming conditions, the charge injection blocking layer and the photoconductive layer were formed under the same conditions as those in Example 1 and the surface layer was formed under conditions shown in Table 5 above. As the electrophotographic photosensitive member, two members were produced under the same film forming conditions (layer forming conditions).

In the same way as in Example 1, one member of the electrophotographic photosensitive members thus produced was used to make analysis on the five equally divided regions in the direction of rotational axis to find the values of the C/(Si+C), Si atom density, C atom density and Si+C atom density in each region. Results obtained are shown in Table 9 below.

TABLE 9

| | Average values | Regions No. 1 | No. 2 | No. 3 | No. 4 | No. 5 |
|---|---|---|---|---|---|---|
| C/(Si + C) | 0.73 | 0.70 | 0.72 | 0.73 | 0.74 | 0.75 |
| C atom density ($\times10^{22}$ atom/cm$^3$) | 4.82 | 4.63 | 4.75 | 4.83 | 4.92 | 4.98 |
| Si atom density ($\times10^{22}$ atom/cm$^3$) | 1.80 | 1.98 | 1.85 | 1.79 | 1.73 | 1.66 |
| Si + C atom density ($\times10^{22}$ atom/cm$^3$) | 6.62 | 6.61 | 6.60 | 6.62 | 6.65 | 6.64 |

As is clear from Table 9, like Example 1, the C/(Si+C) at any arbitrary spots in the respective equally divided regions in the direction of rotational axis of the electrophotographic photosensitive member stood gradually larger from No. 1 toward No. 5. The average value of the Si+C atom density came to $6.62\times10^{22}$ atom/cm$^3$.

About the electrophotographic photosensitive member of Example 5, thus produced, the wear quantity evaluation and the image evaluation were made in the same manner of placement, by using the same conversion electrophotographic apparatus and under the same evaluation conditions as those in Example 1. Results obtained are shown in Table 4 above.

As is clear from Table 4, it was seen that, where the value of the C/(Si+C) was set within the range of up to 0.75 like Examples 2 and 4, the average quantity of wear was more reduced when the Si+C atom density was set larger to $6.60\times10^{22}$ atom/cm$^3$ or more. It was also seen that the image density non-uniformity was kept from varying.

This is considered due to the fact that the distance between constituent atoms of the a-SiC surface layer was shortened and this made their mutual binding force higher and that the graphite component was reduced and hence the a-SiC surface layer was kept from changing in properties, to reduce the quantity of wear.

Example 6

An electrophotographic photosensitive member was so produced that the C/(Si+C) came to from 0.61 or more to 0.75 or less in its whole region and the average value of the Si+C atom density came larger than that in Example 6. The electrophotographic photosensitive member was produced with adjustment of the position of the gas introducing openings 6115 shown in FIG. 6 and by using the plasma-assisted treating apparatus shown in FIG. 6. As the result, as in the results of analysis reported later, the average value of the Si+C atom density was $7.70\times10^{22}$ atom/cm$^3$, which was maximal among electrophotographic photosensitive members produced in all Examples and Comparative Examples. As film forming conditions, the charge injection blocking layer and the photoconductive layer were formed under the same conditions as those in Example 1 and the surface layer was formed under conditions shown in Table 5 above. As the electrophotographic photosensitive member, two members were produced under the same film forming conditions (layer forming conditions).

In the same way as in Example 1, one member of the electrophotographic photosensitive members thus produced was used to make analysis on the five equally divided regions in the direction of rotational axis to find the values of the C/(Si+C), Si atom density, C atom density and Si+C atom density in each region. Results obtained are shown in Table 10 below.

TABLE 10

| | Average values | Regions No. 1 | No. 2 | No. 3 | No. 4 | No. 5 |
|---|---|---|---|---|---|---|
| C/(Si + C) | 0.72 | 0.69 | 0.70 | 0.72 | 0.73 | 0.75 |
| C atom density ($\times10^{22}$ atom/cm$^3$) | 5.53 | 5.29 | 5.36 | 5.52 | 5.64 | 5.82 |
| Si atom density ($\times10^{22}$ atom/cm$^3$) | 2.17 | 2.38 | 2.30 | 2.15 | 2.09 | 1.94 |
| Si + C atom density ($\times10^{22}$ atom/cm$^3$) | 7.70 | 7.67 | 7.65 | 7.67 | 7.73 | 7.76 |

As is clear from Table 10, like Example 1, the C/(Si+C) at any arbitrary spots in the respective equally divided regions in the direction of rotational axis of the electrophotographic photosensitive member stood gradually larger from No. 1 toward No. 5. Here, the average value of the Si+C atom density came to $7.70\times10^{22}$ atom/cm$^3$.

About the electrophotographic photosensitive member of Example 6, thus produced, the wear quantity evaluation and the image evaluation were made in the same manner of placement, by using the same conversion electrophotographic apparatus and under the same evaluation conditions as those in Example 1. Results obtained are shown in Table 4 above.

As is clear from Table 4, it was seen that, where the value of the C/(Si+C) was set within the range of up to 0.75 like Examples 2 and 4, the average quantity of wear was reduced like Example 5 when the Si+C atom density was set larger to $7.70\times10^{22}$ atom/cm$^3$ or more. It was also seen that the image density non-uniformity was kept from varying.

This is considered, like Example 5, due to the fact that the distance between constituent atoms of the a-SiC surface layer was shortened and this made their mutual binding force higher and that the graphite component was reduced and hence the a-SiC surface layer was kept from changing in properties, to reduce the quantity of wear.

Example 7

In Example 7, using an electrophotographic photosensitive member produced under entirely the same conditions as those in Example 5, the wear quantity evaluation and the image evaluation were made in the same way as in Example 3, using the same conversion electrophotographic apparatus as that in Example 3. The results of the wear quantity evaluation and image evaluation are shown in Table 4 above.

From the results shown in Table 4, like Example 5, it was seen that the average quantity of wear was reduced by making the air current generation means pass the air through the inside of the charging member facing the surface of the electrophotographic photosensitive member and thereafter blow over the surface of the electrophotographic photosensitive member. It was also seen that the image density non-uniformity was kept from varying, by setting the C/(Si+C) gradually larger from one end portion toward the other end portion of the electrophotographic photosensitive member in the direction of its rotational axis and by positioning on the air draw-out side the end portion where the C/(Si+C) was larger.

This is considered due to the fact that, like Examples 5, 6 and 7, the distance between constituent atoms of the a-SiC surface layer was shortened and this made their mutual binding force higher and that the graphite component was reduced and hence the a-SiC surface layer was kept from changing in properties, to reduce the quantity of wear.

Example 8

In Example 8, using an electrophotographic photosensitive member produced under entirely the same conditions as those in Example 6, the wear quantity evaluation and the image evaluation were made in the same way as in Example 3, using the same conversion electrophotographic apparatus as that in Example 3. The results of the wear quantity evaluation and image evaluation are shown in Table 4 above.

From the results shown in Table 4, like Example 5, it was seen that the average quantity of wear was reduced by making the air current generation means pass the air through the inside of the charging member facing the surface of the electrophotographic photosensitive member and thereafter blow over the surface of the electrophotographic photosensitive member. It was also seen that the image density non-uniformity was kept from varying, by setting the C/(Si+C) gradually larger from one end portion toward the other end portion of the electrophotographic photosensitive member in the direction of its rotational axis and by positioning on the air draw-out side the end portion where the C/(Si+C) was larger.

This is considered due to the fact that, like Examples 5 and 6, the distance between constituent atoms of the a-SiC surface layer was shortened and this made their mutual binding force higher and that the graphite component was reduced and hence the a-SiC surface layer was kept from changing in properties, to reduce the quantity of wear.

From the results of the foregoing Examples and Comparative Examples, it is seen that the following effect is obtainable in the present invention. That is, the wear quantity non-uniformity is reduced by using the electrophotographic photosensitive member in which the C/(Si+C) in the a-SiC surface layer is within the range of from 0.61 or more to 0.75 or less in its whole region in the direction of its rotational axis and the C/(Si+C) stands gradually larger from one end portion toward the other end portion of the photosensitive member in the direction of its rotational axis, and by positioning on the air draw-out side the end portion where the C/(Si+C) was larger. Then, it is seen that the image density non-uniformity is also kept from varying.

Further, the effect of reducing the average quantity of wear is obtainable by making the air current generation means pass the air through the inside of the charging member facing the surface of the electrophotographic photosensitive member and thereafter blow over the surface of the electrophotographic photosensitive member.

In addition, the quantity of wear is more reduced when the Si+C atom density is within the range of from $6.60\times10^{22}$ atom/cm$^3$ to $7.70\times10^{22}$ atom/cm$^3$. The Si+C atom densities of the electrophotographic photosensitive members produced this time is up to $7.70\times10^{22}$ atom/cm$^3$, but the present inventors consider that the effect of reducing the quantity of wear is obtainable also when it is within the range of more than $7.70\times10^{22}$ atom/cm$^3$.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2009-267746, filed Nov. 25, 2009, and 2010-257817, filed Nov. 18, 2010, which are hereby incorporated by reference herein in their entirety.

What is claimed is:

1. An electrophotographic apparatus which comprises an electrophotographic photosensitive member having a surface layer with an amorphous silicon carbide, wherein;

a ratio of an atom density (C) of carbon atoms to a sum of an atom density (Si) of silicon atoms and the atom density (C) of carbon atoms, C/(Si+C), in the surface layer is set larger from one end portion toward the other end portion of the electrophotographic photosensitive member in the direction of a rotational axis thereof, and is from 0.61 or more to 0.75 or less in the entire region of the electrophotographic photosensitive member in the direction of the rotational axis thereof;

the sum of the atom density of silicon atoms and the atom density of carbon atoms in the surface layer is $6.60\times10^{22}$ atom/cm$^3$ or more; and the electrophotographic apparatus has an air current generation means which draws out air from a side of the one end portion toward a side of the other end portion.

2. The electrophotographic apparatus according to claim 1, wherein the air current generation means has a means for blowing the air from the surface of a charging member facing the surface of the electrophotographic photosensitive member.

* * * * *